US011053708B2

(12) United States Patent
Carter

(10) Patent No.: US 11,053,708 B2
(45) Date of Patent: Jul. 6, 2021

(54) FENCE PANEL SYSTEM AND METHOD OF INSTALLATION

(71) Applicant: Glamagard Pty Ltd, Fyshwick (AU)

(72) Inventor: John Carter, Fyshwick (AU)

(73) Assignee: Glamagard Pty Ltd, Fyshwick (AU)

( * ) Notice: Subject to any disclaimer, the term of this patent is extended or adjusted under 35 U.S.C. 154(b) by 395 days.

(21) Appl. No.: 16/188,586

(22) Filed: Nov. 13, 2018

(65) Prior Publication Data

US 2019/0145125 A1 May 16, 2019

(30) Foreign Application Priority Data

Nov. 15, 2017 (AU) ..... 2017904623

(51) Int. Cl.
*E04H 17/16* (2006.01)
*E04H 17/14* (2006.01)
*E04H 17/20* (2006.01)

(52) U.S. Cl.
CPC ..... *E04H 17/168* (2013.01); *E04H 17/1404* (2013.01); *E04H 17/1413* (2013.01); *E04H 17/20* (2013.01); *E04H 17/1456* (2021.01)

(58) Field of Classification Search
CPC ..... E04H 17/1447; E04H 17/1452; E04H 17/1456; E04H 17/1465; E04H 17/1488; E04H 17/14; E04H 17/17; E04H 17/20; E04H 17/168
See application file for complete search history.

(56) References Cited

U.S. PATENT DOCUMENTS 6,293,523 B1 * 9/2001 Fendler ..... E04H 17/168 256/27
2006/0186390 A1 * 8/2006 Richards ..... E04H 17/1413 256/22
2011/0024060 A1 * 2/2011 Brownbill ..... E04H 17/168 160/188
2017/0370121 A1 * 12/2017 Lindsay ..... E04H 17/20

* cited by examiner

*Primary Examiner* — Jonathan P Masinick
(74) *Attorney, Agent, or Firm* — Fitch, Even, Tabin & Flannery LLP

(57) ABSTRACT

A fence panel system comprises a first elongate frame member having a plurality of panel spacers projecting from a rearward facing wall in a plane perpendicular to the longitudinal axis of the first elongate frame member, such that respective spacer pairs define open-ended channels therebetween that, in use, are adapted to receive fence panel ends. A second elongate frame member is adapted to secure to the first elongate frame member so as to close the open-ended channels for retaining the fence panel ends therein.

12 Claims, 9 Drawing Sheets

FENCE PANEL SYSTEM AND METHOD OF INSTALLATION

CROSS-REFERENCE TO RELATED APPLICATION

This application claims the benefit under 35 U.S.C. § 119 of Australian Patent Application No. 2017904623, filed Nov. 15, 2017, which is hereby incorporated by reference in its entirety.

FIELD OF INVENTION

The present invention relates to a fence panel system that can be used in confined spaces.

BACKGROUND OF INVENTION

Fence screens are used to create boundaries and provide privacy. Often, fencing screens will comprise a pair of vertical frames (or "uprights") with one or more panels or "slats" extending therebetween.

Aluminium frames are commonly found in modern fencing screens. One particular screen system includes a pair of frames having slots formed along respective internally facing walls. Fence panels (formed of aluminium or otherwise) extend between the frames such that their respective ends are received in opposing slots.

Where the fencing screen is to be fixed between an immovable structure (e.g. between a pair of posts, walls, etc.), a number of steps are taken. Firstly, the opening is carefully measured and the screen frames and panels are cut to size. The panels are then inserted into the slots are the screen is fully assembled. Often, the cutting and assembly is carried out at the point of manufacture. Once the assembled fence panel arrives on site, the frame is positioned between the immovable structure and then secured in place.

Securing the assembled fence panel can be carried out in a number of different ways. One form of securement involves initially mounting a pair of side rails that each have a u-shaped cross-sectional profile to opposing walls of the structure (i.e. such that the U-shaped openings in the rails face one another). The rails are mounted using one or more screws that are screwed through a rear wall of the rail and into the structure. The holes in the rail through which the screws pass may be pre-drilled or formed in-situ (e.g. using a self-tapping screw). The assembled panel is then positioned above the rail before being slid downwardly into position. One or more fixing screws are then screwed through one of the side walls of the rail and into the fence panel frame. However, a disadvantage with this method of installation is that there is not always suitable clearance for allowing the assembled frame to be positioned above the frames. In this situation a pair of frames having an L-shaped cross-sectional profile may be used (i.e. allowing forward entry of the assembled panel).

However, it is not uncommon for an assembled frame to be manufacture and delivered only to find that it does not fit in position (e.g. due to a poor measurement, a peculiarity in the shape of the space that was not previously accounted for, etc.). In this situation, it is often necessary to send the assembled panel back to the manufacturer for disassembly and re-assembly, after the necessary adjustments have been made. This clearly adds to the cost and time taken to complete the project.

Further, it will be appreciated that while a fence panel that has been cut too long can be re-cut to size, a fence panel that is too short, even by a small margin, will need to be discarded further adding to the cost of the installation.

Another disadvantage with the afore-mentioned securing techniques is that the fixing screws used to secure the assembled panel to the L or U-shaped rails are externally visible and can detract from the overall aesthetic of the fence panel. Indeed, the rails themselves can also detract from the aesthetic appearance in some situations.

It would be advantageous if there was provided a fence panel system and securement technique that addressed one or more of the deficiencies set out above.

SUMMARY OF INVENTION

In accordance with a first aspect of the present invention there is provided a fence panel system comprising: a first elongate frame member having a plurality of panel spacers projecting from an rearward facing wall in a plane perpendicular to the longitudinal axis of the first elongate frame member, such that respective spacer pairs define open-ended channels therebetween that, in use, are adapted to receive fence panel ends; a second elongate frame member adapted to secure to the first elongate frame member so as to close the open-ended channels for retaining the fence panel ends therein.

In an embodiment a forward facing surface of the fence panels is adapted to bear upon a bearing surface of the rearward facing wall.

In an embodiment the system further comprises an adhesive means disposed on or adjacent the bearing surface between the respective spacer pairs for holding the fence panel ends in place until the second elongate frame member is secured to the first elongate frame member.

In an embodiment the adhesive means extends substantially the length of the first bearing surface.

In an embodiment a rearward facing wall of each fence panel is adapted to bear upon a second bearing surface disposed on an forward facing wall of the second elongate frame member.

In an embodiment distal ends of the panel spacers locate within a longitudinal channel disposed in or adjacent the forward facing wall of the second elongate frame member to thereby close the open-ended channels.

In an embodiment the system further comprises an adhesive means disposed on the second bearing surface.

In an embodiment the first and second frame members are arranged to snap fit together.

In an embodiment the engagement means comprises: a first u-channel disposed on the first frame a second u-channel disposed on the second frame wherein the first u-channel is adapted to be received by the second u-channel; or wherein the second u-channel is adapted to be received in the first u-channel.

In an embodiment the system further comprises corresponding first and second elongate frame members for receiving and securing opposite ends of the respective fence panels.

In an embodiment the panel spacers are evenly spaced along the length of the first frame member.

In accordance with a second aspect there is provided a method of installing a fence panel system as claimed in any one of the preceding claims, comprising: (a) fastening the first elongate frame member of a first frame to a structural element using a fixing means, the fixing means being located through one or more holes in an outer wall of the first elongate frame member; (b) fastening the first elongate frame member of a second frame to an opposing structural element using a fixing means in the same manner as for the first frame; (c) forwardly mounting one or more fence panels such that respective ends of the fence panels locate with opposing open-ended channels of the frames; (d) attaching the second elongate frame members to the first elongate frames members to secure the fence panels and such that the fixing means are no longer externally visible.

BRIEF DESCRIPTION OF DRAWINGS

Embodiments of the present invention will now be described, by way of example only, with reference to the accompanying drawings, in which.

DETAILED DESCRIPTION

Embodiments of the invention described herein relate to a fence panel system comprising a pair of upright frames for securing multiple fence panels therebetween. Each frame comprises a first elongate frame member having multiple panel spacers disposed along its length. The spacers project from an inner rearwardly facing face of the first frame member in a plane perpendicular to its longitudinal axis. Open-ended channels are formed between respective spacer pairs for receiving an end of a fence panel (i.e. such that each frame receives a respective end of the fence panel). A second elongate frame member is adapted to secure to the first elongate frame member to close the open-ended channels, thereby retaining the fence panel ends therein.

The following description is set out in the context of a fence panel system disposed between two immovable structures (e.g. walls or posts). Each of the upright frames are secured to a respective one of the structures using hidden fixing means, as will be described in more detail in subsequent paragraphs. The fence panels can be formed of any suitable material (e.g. wood, aluminium, composite material, etc.) and have a generally rectangular cross section. It will be understood, however, that one or more of the frames may be free standing (e.g. concreted into the ground or mounted to a structure via any suitable fixing means).

Figure 1:
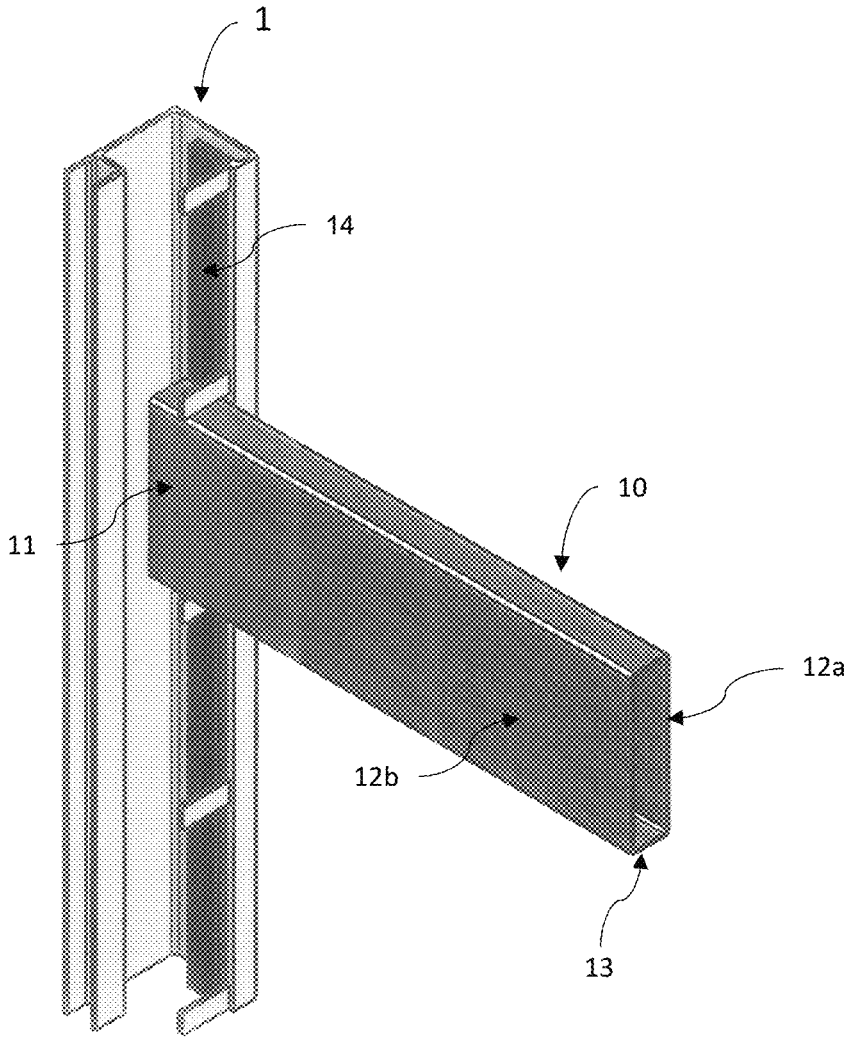
FIG. 1 is an isometric view a partially assembled fence frame, according to an embodiment of the present invention.

With reference to FIG. 1, there is shown a partially assembled fence panel system, according to a first embodiment of the present invention. As shown, the system comprises a first elongate frame member (1) adapted to receive multiple fence panels (10).

Figure 2A:
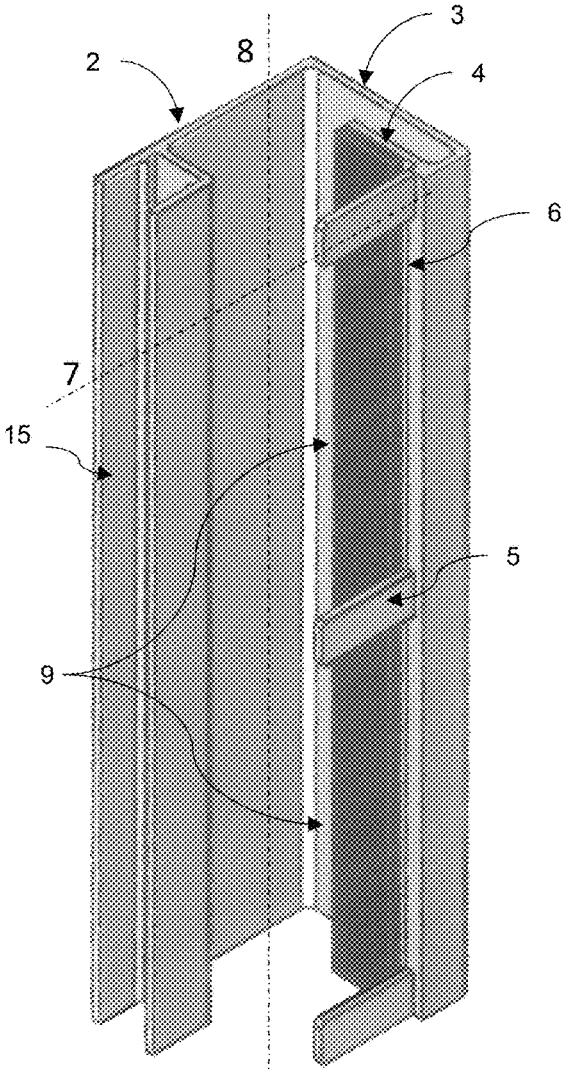
FIG. 2*a* is an isometric view of a section of a first frame member of the fence frame of FIG. 1.
Figure 2B:
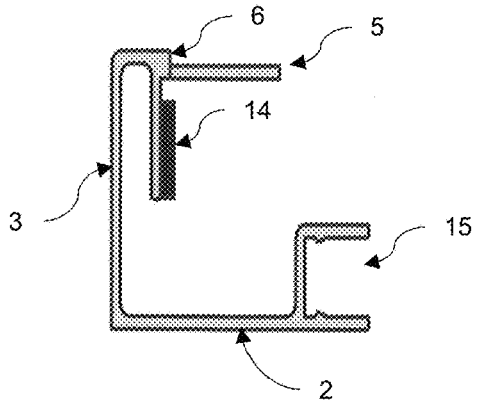
FIG. 2*b* is a cross sectional view of the section shown in FIG. 2*a;*

With additional reference to FIGS. 2*a* and 2*b*, the first elongate frame member (1) has a generally L-shaped cross-sectional profile comprising a first outer wall (2) and a second outer wall (3) disposed at right angles to each other. At a distal end, the second outer wall (3) wraps back on itself to form a first inner wall (4). A plurality of panel spacers (5) project from an rearwardly stepped bearing surface (6) of the first inner wall (4) in a plane (7) perpendicular to the longitudinal axis (8). According to the illustrated embodiment, the panel spacers (5) are finger like and have a generally rectangular profile. According to the illustrated embodiment, the spacers (5) are evenly spaced to define rectangular open-ended channels (9) between pairs of spacers (5). The first elongate frame member (1) may end with either a spacer (5), as per FIG. 1, or alternatively in an open-ended fashion, depending on the desired configuration.

The open-ended channels (9) are adapted to receive rectangular fence panels ends (11), as shown in FIG. 1. In more detail, a forward facing wall (12*a*) of each panel (10) bears upon the bearing surface (6), while an adjacent bottom wall seats on a lower one of the panel spacers (5).

An adhesive means (14) is disposed on the first inner wall (4) between the respective spacer pairs (5) for adhering to the forward facing wall (12*a*) of the fence panel ends (11), so as to temporarily hold the ends (11) in place until a second elongate frame member (20) is secured to the first elongate frame member (1), as will be described in more detail in subsequent paragraphs. Persons skilled in the art will appreciate that the adhesive means (14) could extend substantially the length of the first inner wall (4), or could consist of multiple separate adhesive elements disposed between the respective pairs of spacers (5). It will be understood that the rearwardly stepped bearing surface (6) ensures that the adhesive means (14) is not visible when the fence is completed. According to the illustrated embodiment, the adhesive means comprises double sided adhesive tape.

Figure 3A:
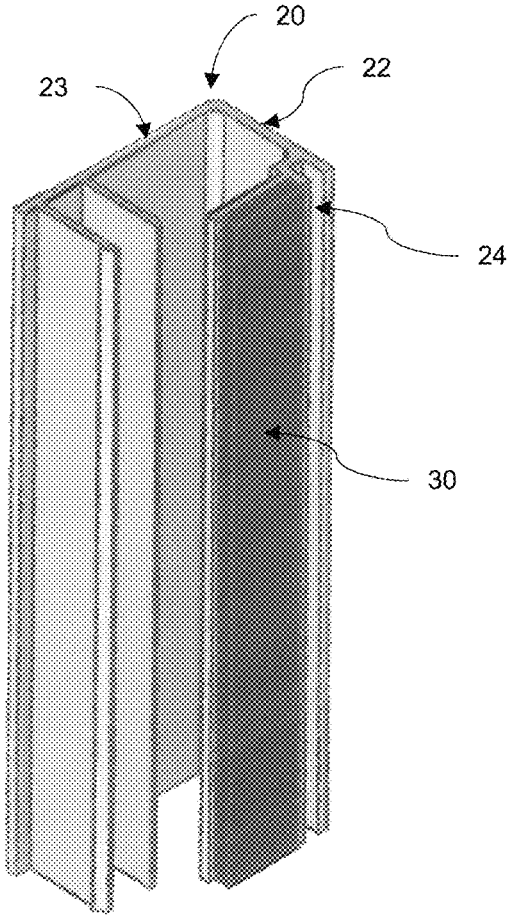
FIG. 3*a* is an isometric view of a section of a second frame member, in accordance with an embodiment of the invention.
Figure 3B:
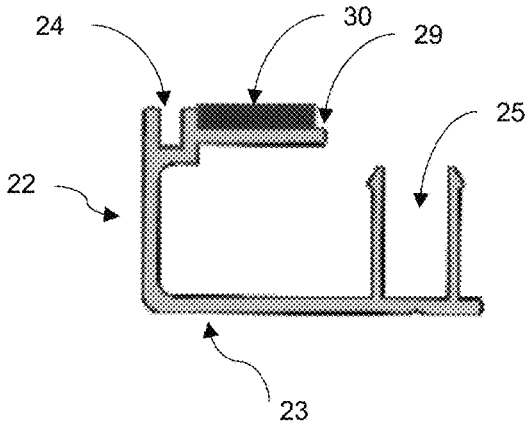
FIG. 3*b* is a cross sectional view of the section shown in FIG. 3*a;*

With reference to FIGS. 3*a* and 3*b*, there is shown a second elongate frame member (20) adapted to secure to the first elongate frame member (1) for retaining the panels (10). With particular reference to FIG. 3*b*, the second elongate frame member (20) has a generally L-shaped cross-sectional profile comprising a first wall (22) disposed at right angles to a second wall (23). The first wall (22) terminates in a longitudinal channel (24) which extends along the length of the second elongate frame member (20). The channel (24) is adapted to receive distal ends of the spacers (5), thereby closing the open-ended channels (9) for retaining the fence panel end (11) therein.

Returning to FIGS. 2*a* and 2*a*, the first outer wall (2) of the first elongate frame member (1) comprises a first u-shaped channel (17) located at a distal end thereof. The channel (15) opens outwardly in the same direction as the spacers (5) and extends the length of the frame member (1). The first u-shaped channel (15) is adapted to receive therein a second u-shaped channel (25) disposed on the second elongate frame member (20). The second u-shaped channel (25) is located adjacent a distal end of the second wall (23) and extends longitudinally along an inner face thereof.

Figure 4A:
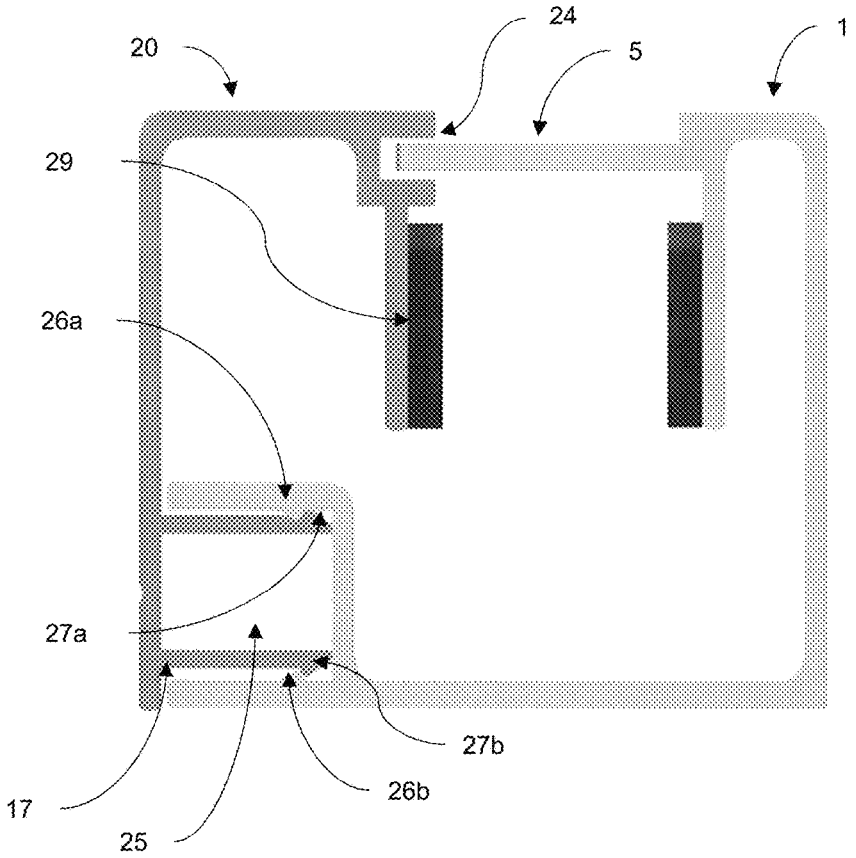
FIG. 4*a* is an end view of the first and second elongate frame members of FIGS. 2 and 3 secured together for retaining a plurality of fence panels, in accordance with an embodiment of the present invention.

In an embodiment of the invention, and with additional reference to FIG. 4*a*, the second u-shaped channel (25) is adapted to snap fit into the first u-shaped channel (15). In more detail, a pair of longitudinally extending external nubs (27*a*, 27*b*) are disposed on respective outer walls of the second u-shaped channel (19) adjacent distal ends thereof. Similarly, a pair of longitudinally extending internal nubs (26*a*, 26*b*) are disposed on respective inner walls of the first u-shaped channel (17) adjacent distal ends thereof. During securement, the external nubs (27*a*, 27*b*) are forced to travel over the internal nubs (26*a*, 26*b*), causing the second u-shaped channel walls to momentarily deform inwardly before returning to their uncompressed state. Both sets of nubs (26*a*, 26*b*, 27*a*, 27*b*) have a barbed outer profile which prevents the elongate members from becoming readily detached after insertion (i.e. without excessive pulling force being applied).

Figure 4B:
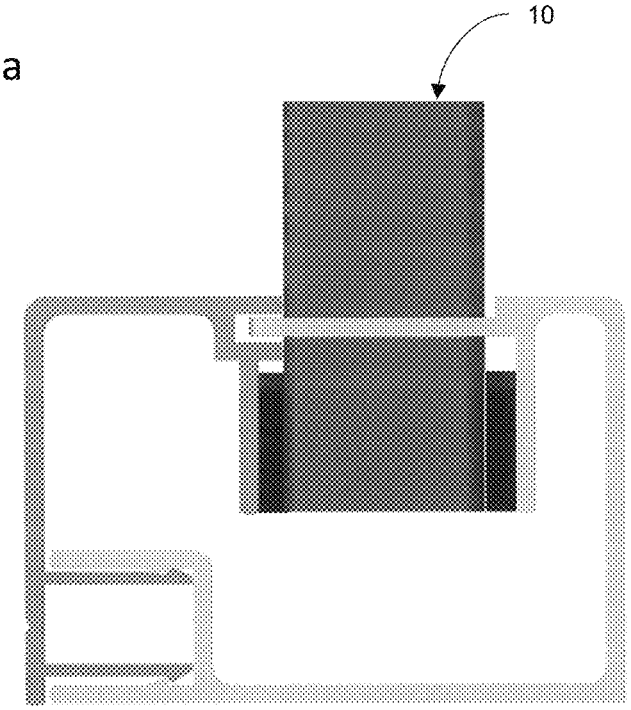
FIG. 4*b* is the end view of FIG. 4*a* showing a fence panel end retained therebetween.

To prevent movement of the panel (10) within the channels (9), an adhesive means may be applied to a rearward facing wall of the panels (10). In more detail, a second inner wall (29) extends internally at right angles to the longitudinal channel (16) and has a surface for bearing on a rearward facing wall (12*b*) of the fence panel ends. An adhesive means (30) may be disposed on the bearing surface. Persons skilled in the art will appreciate that the adhesive means (30) could be formed of numerous separate adhesive elements disposed on the second inner wall (29), or alternatively comprise a single strip of adhesive. According to the illustrated embodiment, the adhesive means comprises double sided adhesive tape. As shown in FIG. 4*b*, once assembled, the adhesive means (26, 30) sandwich the respective panel ends (11) preventing sideward movement.

Installation

Figure 5:
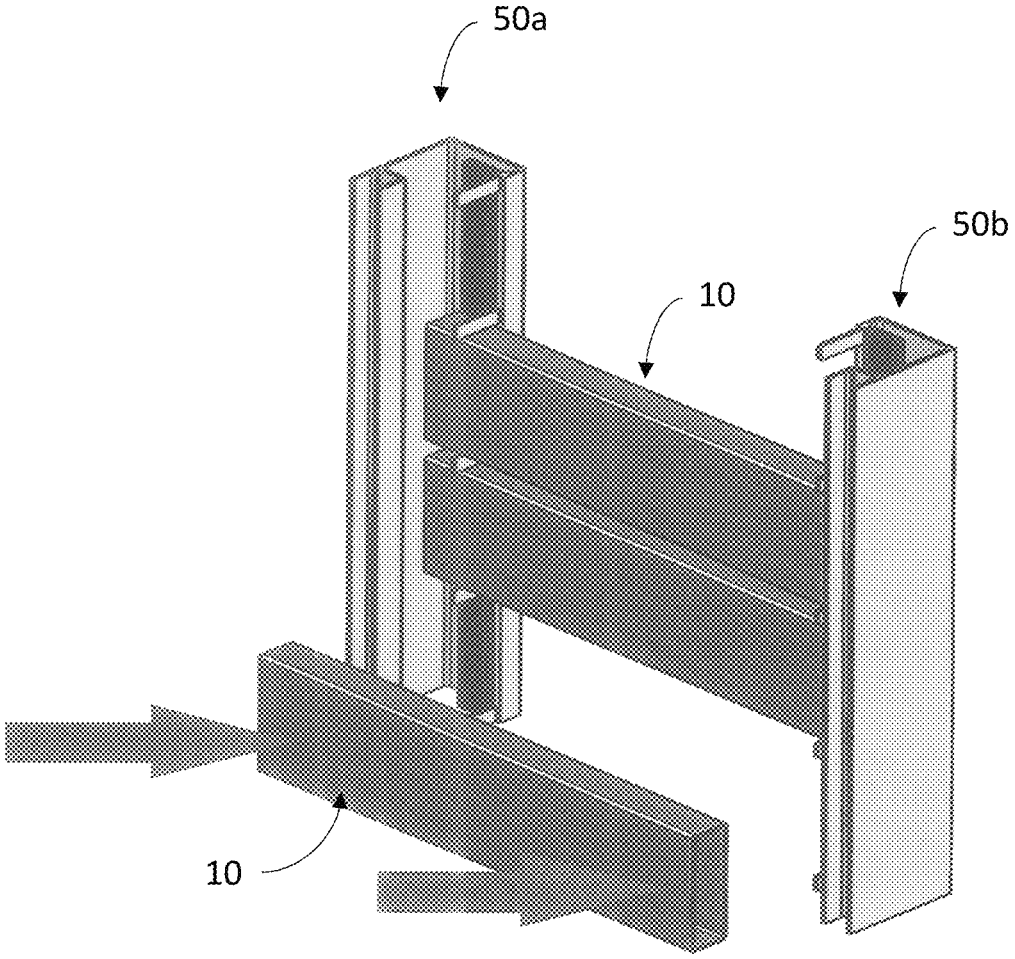
FIG. 5 is a schematic illustrating installation of fence panels, in accordance with an embodiment of the present invention.
Figure 6:
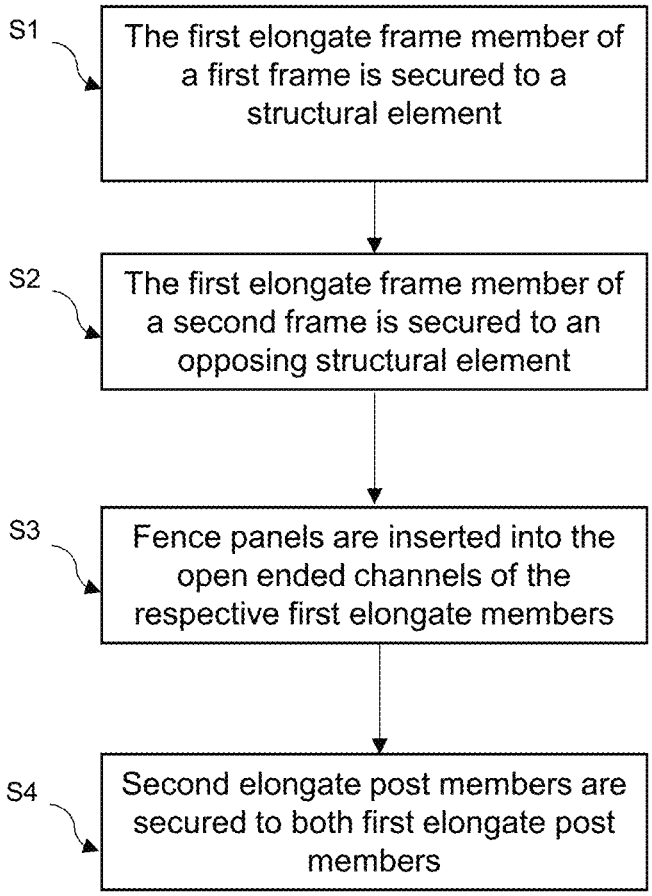
FIG. 6 illustrates the process for installing a fence system in accordance with an embodiment of the invention.

A method of installing a fence system of the present invention will now be described with reference to the schematic of FIG. 5 and process flow of FIG. 6.

According to this method of installation, at step S1, the first elongate frame member (1) of a first frame (50*a*) is secured to a structural element (e.g. wall or post) using a suitable fastener means (e.g. screws, dyna-bolts, nails, etc). According to a preferred embodiment, the fastener(s) passes through one or more holes in the first wall (2) of the elongate member (1) for securing the first elongate frame member (1) to the structural element. The holes may be pre-drilled/formed or made during installation (e.g. by a drill bit, or formed by the fastener itself during drilling, such as by using a self-tapping screw). An advantage of the present invention is that once the second elongate member (20) is secured to the first elongate member (1) the fixing means is no longer visible, thereby providing a pleasing overall aesthetic appearance.

At step S2, the first elongate frame member (1) of the second frame (50*b*) is subsequently secured to an opposing structural element in the same manner as outlined above.

Once the frames (50*a*, 50*b*) are secured, at step S3 the fence panels (10) are then inserted, from a forward direction, such that the respect ends (11) are received in the opposing open-ended channels (9). It will be appreciated that the space between the spacers (5) and the first wall (2) of the first elongate frame member (1) provides a tolerance for cutting the fence frame lengths (i.e. such that they do not need to be of an exact length to work with the system, while still appearing as though they are the same length once the fence panel system is completed). Thus, if desired, the fence panels can be pre-cut to an approximate length thereby obviating the need for any on-site cutting. In the event that the lengths are determined to be too long when on-site, they can readily be cut to fit. The adhesive means (14) temporarily holds the panels in place until all panels have been loaded.

The final step (step S4) involves securing the second elongate frame member (20) to the first elongate frame member (1) for both frames (50*a*, 50*b*), such that the open-ended channels (9) are closed and the fence panels ends (11) are retained therein.

The fence panel system and method of installation as outlined above advantageously allows the fence to be readily installed on-site for any desired opening, obviating the need for accurate pre-measurement and pre-manufacture, that has the various disadvantages outlined in the background of the invention.

Figure 7:
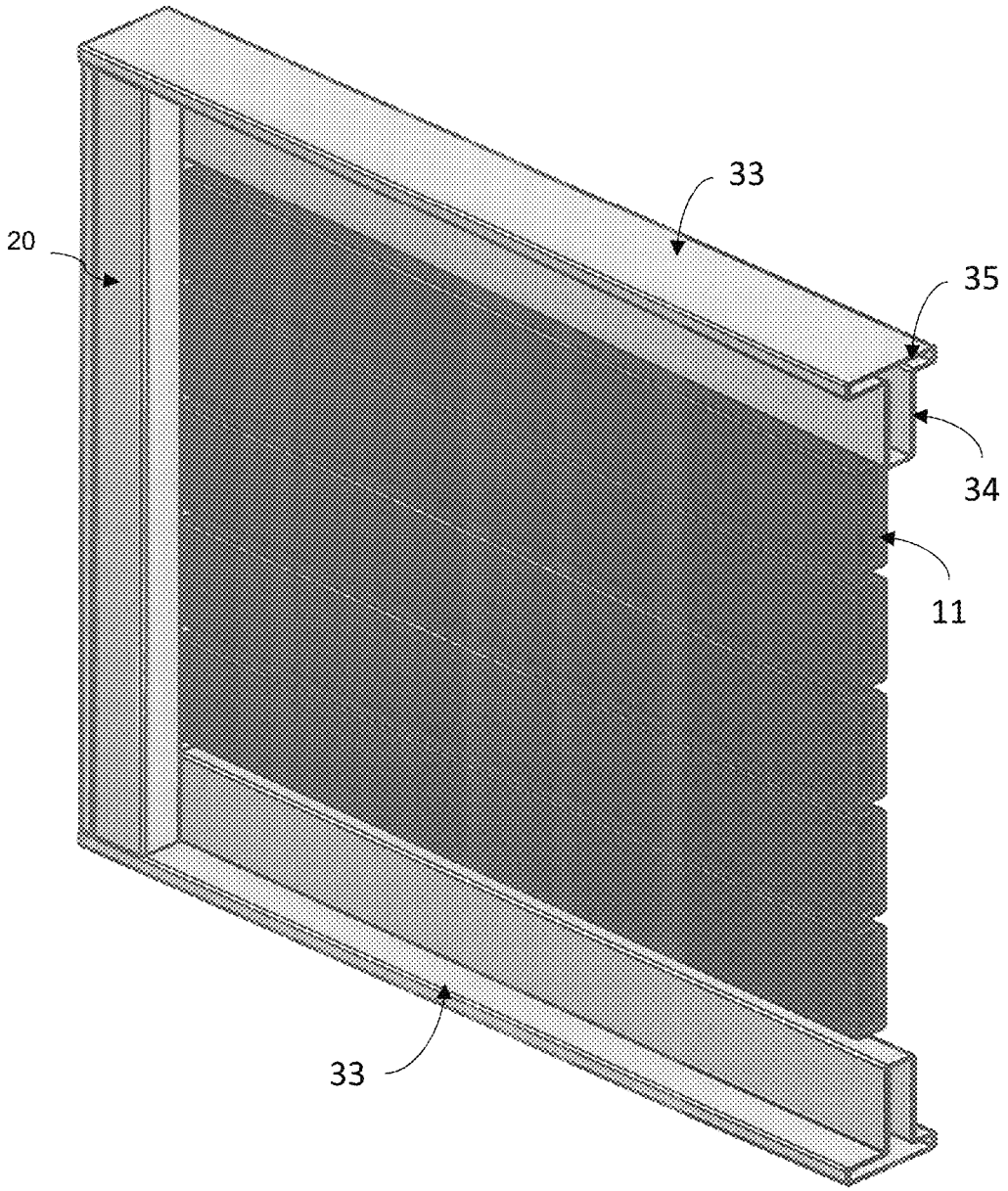
FIG. 7 is an isometric view of an assembled fence panel system, in accordance with an embodiment of the present invention.

As previously stated, the first elongate frame member (1) may end with either a spacer (5) or with an open-ended channel (9). An embodiment of the invention wherein the fence panel frame members (1, 20) end with an open-ended channel (9) is depicted in the partially assembled schematic of FIG. 7. In this instance, the fence panel system further comprises a top and bottom rail (33) having a cross sectional "T" shape. The rail (33) is inserted like any other fence panel into the upper-most open-ended channel (9) of the first elongate member (1) such that the stem (34) of the T is aligned with the other fence panels, and the hat (35) of the T covers the previously exposed rectangular opening of the combined first and second elongated frame members (1, 20).

Figure 8:
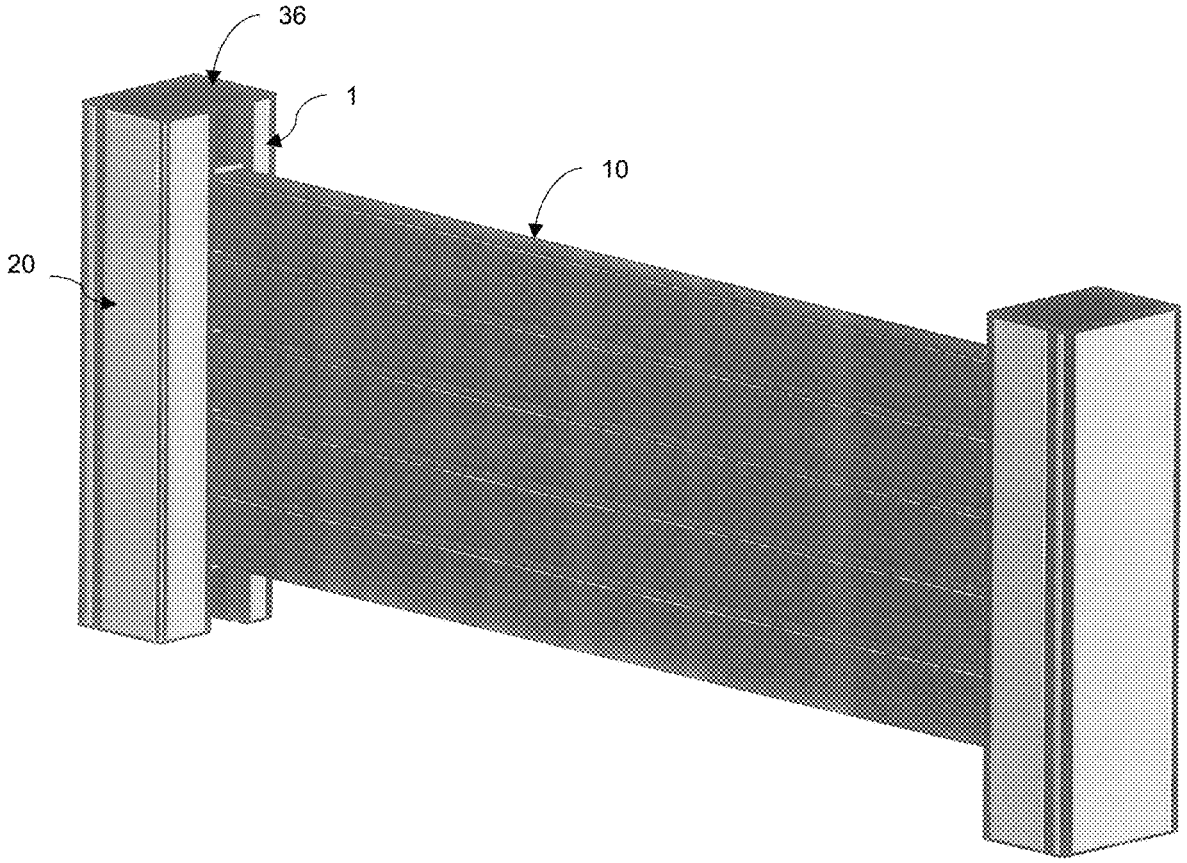
FIG. 8 is an isometric view of an assembled fence panel system, in accordance with an alternative embodiment of the present invention.

Alternatively, as shown in FIG. 8, the exposed opening can be covered with a cap (36) having a corresponding rectangular shape of the assembled frame (1, 20) cross section, to prevent contaminants, such as water, entering the frame. The cap (36) may be made of rubber, plastic, or any other desired material.

Figure 9:
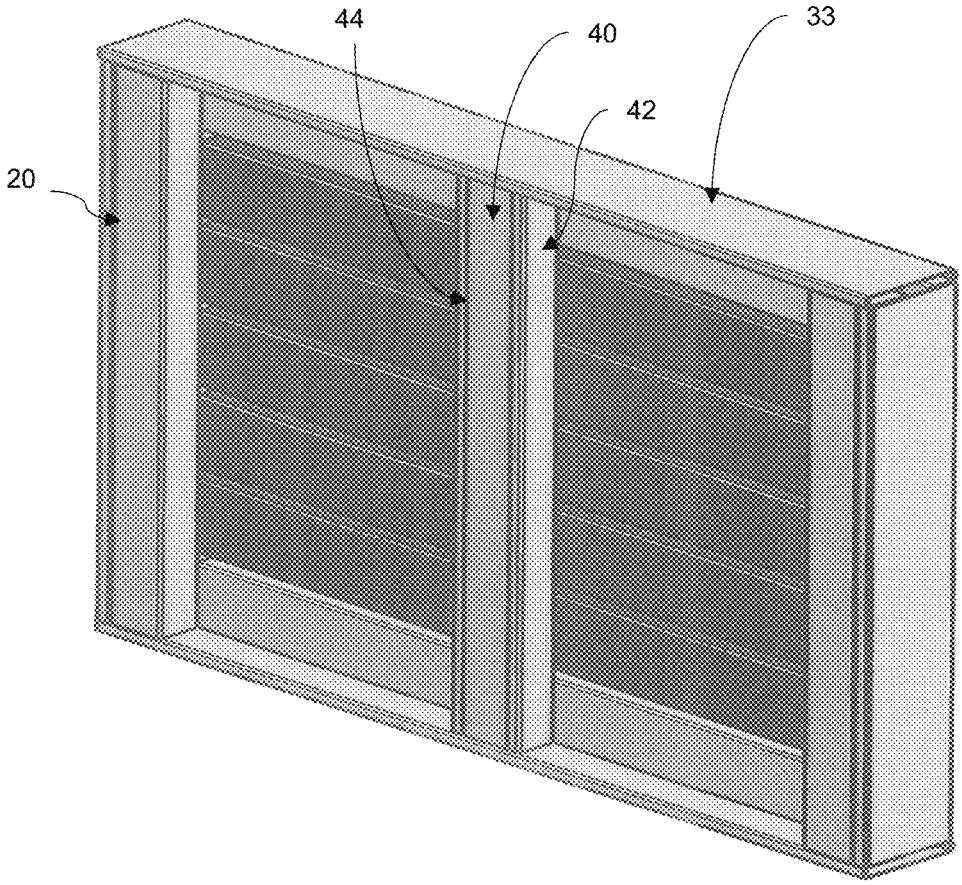
FIG. 9 is an isometric view of an assembled fence panel system, in accordance with yet another alternative embodiment of the present invention.

Yet another embodiment of the fence panel system is shown in FIG. 9, in which for long spans a bracing rail (40) may be fitted. The bracing rail (40) may extend between the top and bottom rails (33). An outer frame member (42) may be screwed to the stems (34) of the top and bottom rail, with an inner frame member (44) adapted to snap into the outer frame (42) for hiding the fixing means.

According to embodiments described above, the elongate frame members (1, 20) and bracing rail (21) are formed of aluminium. It will be understood that they may be made of other suitable material without departing from the nature of the invention. Persons skilled in the art will appreciate that the elongate frame members (1, 20) can be of any length, width or height, depending on the desired fence panel configuration.

The first wall (2) of an elongate frame member may have a cross sectional length that is longer or shorter than the second wall (3), and vice versa. The first and second elongate members (1, 20) are preferably formed by an extrusion process.

In an alternative embodiment to that described above, the panel spacers (5) may be of different sizes, such as some being thicker to support heavier panels. Further, the spacers (5) may be unevenly spaced for accommodating different sized panels.

It will be understood that the space between the spacers (5) and wall (2) may be increased or decreased for changing the thickness of the frame and adjusting the fence panel length tolerance. In an embodiment, the inner wall (4) may be omitted completely.

Further, more than one fence panel end (11) may be received between a pair of spacers (5). For example, three fence panel ends (11) may be received within a single open-ended channel (9) if desired for aesthetic purposes.

In an alternative embodiment, a cushioning means, such as foam or rubber, may be provided in place of the adhesive means (30). In an alternative embodiment, the second inner wall (29) may be flush with the ends of the longitudinal channel 24 such that the cushioning and/or adhesive means may be omitted altogether.

In an embodiment of the invention, the longitudinal channel (24) may have rounded or bevelled edges for guiding the spacers ends. The longitudinal channel (24) may be of any size, so long as it is able to retain the distal ends of the panel spacers.

The adhesive means (14, 30) may be any means that allows at least partially gripping on the fence panels. For example, glue, foam, rubber, etc. In an embodiment of the invention the adhesive means (14, 30) may be omitted on the first frame member, the second frame member, or both members.

In this specification, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

The preceding description is provided in relation to several embodiments which may share common characteristics and features. It is to be understood that one or more features of any one embodiment may be combinable with one or more features of the other embodiments. In addition, any single feature or combination of features in any of the embodiments may constitute additional embodiments.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. Terms such as "upper" and "lower", "above" and "below" and the like are used as words of convenience to provide reference points and are not to be construed as limiting terms.

In addition, the foregoing describes only some embodiments of the inventions, and alterations, modifications, additions and/or changes can be made thereto without departing from the scope and spirit of the disclosed embodiments, the embodiments being illustrative and not restrictive.

Furthermore, the inventions have described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the inventions. Also, the various embodiments described above may be implemented in conjunction with other embodiments, e.g., aspects of one embodiment may be combined with aspects of another embodiment to realize yet other embodiments.

Further, each independent feature or component of any given assembly may constitute an additional embodiment.

The invention claimed is:

1. A fence panel system comprising:

a first elongate frame member having a plurality of panel spacers projecting from a rearward facing wall in a plane perpendicular to a longitudinal axis of the first elongate frame member, such that respective spacer pairs define open-ended channels therebetween that, in use, are adapted to receive fence panel ends;

a second elongate frame member adapted to secure to the first elongate frame member so as to close the open-ended channels for retaining the fence panel ends therein.

2. The fence panel system as in claim 1, wherein a forward facing surface of the fence panels is adapted to bear upon a bearing surface of the rearward facing wall.

3. The fence panel system as in claim 2, further comprising an adhesive means disposed on or adjacent the bearing surface between the respective spacer pairs for holding the fence panel ends in place until the second elongate frame member is secured to the first elongate frame member.

4. The fence panel system as in claim 2, wherein the adhesive means extends substantially the length of the first bearing surface.

5. The fence panel system as in claim 2, wherein a rearward facing wall of each fence panel is adapted to bear upon a second bearing surface disposed on a forward facing wall of the second elongate frame member.

6. The fence panel system as in claim 5, wherein distal ends of the panel spacers locate within a longitudinal channel disposed in or adjacent the forward facing wall of the second elongate frame member to thereby close the open-ended channels.

7. The fence panel system as in claim 5, further comprising an adhesive means disposed on the second bearing surface.

8. The fence panel system as in claim 1, wherein the first and second frame members are arranged to snap fit together via engagement means.

9. The fence panel system as in claim 8, wherein the engagement means comprises:

a first u-channel disposed on the first frame; and a second u-channel disposed on the second frame, wherein the first u-channel is adapted to be received by the second u-channel or wherein the second u-channel is adapted to be received in the first u-channel.

10. The fence panel system as in claim 1, further comprising:

a third elongate frame member having a plurality of panel spacers projecting from a rearward facing wall in a plane perpendicular to a longitudinal axis of the third elongate frame member, such that respective spacer pairs define open-ended channels therebetween that, in use, are adapted to receive opposite fence panel ends; and a fourth elongate frame member adapted to secure to the third elongate frame member so as to close the open-ended channels for retaining the opposite fence panel ends therein.

11. The fence panel system as in claim 1, wherein the panel spacers are evenly spaced along the length of the first frame member.

12. A method of installing a fence panel system as claimed in claim 1, comprising:

(a) fastening the first elongate frame member of a first frame to a structural element using a fixing means, the fixing means being located through one or more holes in an outer wall of the first elongate frame member;

(b) fastening the first elongate frame member of a second frame to an opposing structural element using a fixing means in the same manner as for the first frame;

(c) forwardly mounting one or more fence panels such that respective ends of the fence panels locate with opposing open-ended channels of the frames; and (d) attaching the second elongate frame members to the first elongate frames members to secure the fence panels and such that the fixing means are no longer externally visible.

* * * * *